US005604932A

United States Patent [19]

Lawicki

[11] Patent Number: 5,604,932

[45] Date of Patent: Feb. 25, 1997

[54] POUCH FOR WHEELCHAIR OCCUPANT

[76] Inventor: Monique M. Lawicki, 2293 Wilshire, Westland, Mich. 48186

[21] Appl. No.: 607,219

[22] Filed: Feb. 26, 1996

[51] Int. Cl.[6] ..... A41D 3/00; A41B 13/06

[52] U.S. Cl. ..... 2/69.5; 2/69; 2/46

[58] Field of Search ..... 2/69, 69.5, 47, 2/48, 114, 46, 83, 22; 5/482, 484, 485, 494; 297/466, 188, 464; 280/250.1, 304.1

[56] References Cited

U.S. PATENT DOCUMENTS

| | | | |
|---|---|---|---|
| 704,276 | 7/1902 | Sorensen | 2/69 |
| 1,074,389 | 9/1913 | Sullivan | 2/69 |
| 2,574,748 | 11/1951 | Meighan | 5/494 |
| 2,705,325 | 4/1955 | Bogenberger | 2/69 |
| 2,980,169 | 4/1961 | Campbell | 2/69 |
| 3,597,764 | 8/1971 | Povey | 2/69.5 |
| 3,727,238 | 4/1973 | Wolfson | 2/69 |
| 4,363,141 | 12/1982 | Doster | 2/69 |
| 4,651,346 | 3/1987 | Hale | 2/46 |
| 4,753,483 | 6/1988 | Beier | 2/69.5 |
| 4,932,077 | 6/1990 | Dobbs | 2/69 |
| 5,014,376 | 5/1991 | Doran et al. | 5/494 |
| 5,025,536 | 6/1991 | Vielhauer | 2/114 |
| 5,283,909 | 2/1994 | Hill | 2/69 |
| 5,437,061 | 8/1995 | Kenner | 2/69.5 |

*Primary Examiner*—Amy B. Vanatta
*Attorney, Agent, or Firm*—Charles W. Chandler

[57] ABSTRACT

A wheelchair having a pouch for enclosing both the legs and feet as well as the wheelchair footrest frame. Straps wrap the pouch around both the seat of the wheelchair as well as the thighs of the occupant.

5 Claims, 2 Drawing Sheets

POUCH FOR WHEELCHAIR OCCUPANT

Background of the Invention

Many invalids spend considerable time in a wheelchair and frequently must be transposed to and from work, school or the like. They do not move their legs much because they are not ambulatory and therefore have poor circulation with cold feet and legs. It is a common practice to warm the patient by using a thermal blanket. The blanket is time consuming to secure to the patient, does not hold properly, and frequently slips down and gets in the way.

Pouches or lap huggers are sometimes used. Examples of such prior art may be found in U.S. Pat. No. 4,363,141 which was issued Dec. 14, 1982, to Elizabeth Doster for "Quilt for Use in Wheelchairs"; U.S. Pat. No. 4,651,346 which was issued Mar. 24, 1987, to Shirley A. Hale for "Lap Hugger"; U.S. Pat. No. 4,932,077 which was issued Jun. 12, 1990, to Dolores Dobbs for "Lap Robe for Wheelchair Occupant"; and U.S. Pat. No. 5,283,909 which was issued Feb. 8, 1994, to Lucille K. Hill for "Lap Hugger".

Such garments typically are wrapped around the feet and legs and usually comprise a pouch for containing the patient's legs. A drawstring may be used to tighten the pouch around the patient's legs. They are difficult to use, because like a blanket, they tend to slip down and uncover the patient's legs.

Summary of the Invention

The broad purpose of the present invention is to provide an improved pouch for the occupant of a wheelchair. The preferred embodiment of the invention comprises a pouch having an opening for receiving the patient's legs and feet and a part of the wheelchair frame. The pouch is dimensioned such that it may be placed on the patient by initially seating the patient in the wheelchair with her feet on the footrest and then raising the pouch to cover both feet and legs as well as the footrest and the footrest frame.

The pouch has a lower panel that extends up under the lower part of the thighs and beneath the seat on which the patient sits. An upper panel extends up on the lap, beyond the lower panel. A strap attached to the lower panel, may be wrapped around the upper panel and the patient's thighs to secure the pouch to the wheelchair. Thus, the pouch cannot slide down the patient's legs. In addition, because the wheelchair frame is rigid, the pouch can be easily slipped up onto the patient's legs and thighs.

The pouch is preferably made of a water repellant material and is durable in the cold. It has a center layer of insulation used in outer winter garments, and an inner layer of a warm soft flannel. The pouch can be designed to fit different size wheelchairs and may be made in different weights such as for spring, without the center insulation.

In addition, the pouch can be worn for lounging on patio furniture, sitting on the floor or in a vehicle.

Still further objects and advantages of the invention will become readily apparent to those skilled in the art to which the invention pertains upon reference to the following detailed description.

Description of the Drawings

The description refers to the accompanying drawings in which like reference characters refer to like parts throughout the several views, and in which.

Description of the Preferred Embodiment

Figure 1:
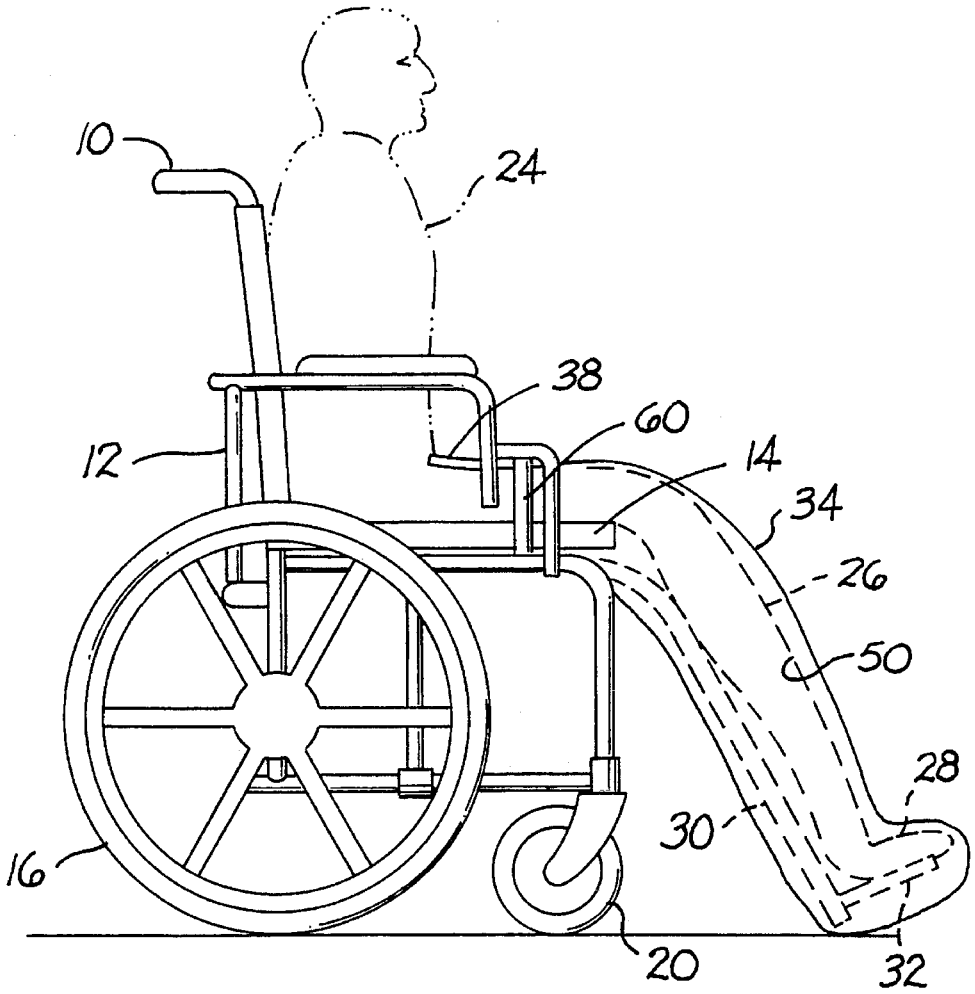
FIG. 1 is an elevational view of a pouch mounted on a wheelchair, including the legs of a patient illustrated in phantom.

Referring to the drawings, FIG. 1 illustrates a conventional wheelchair 10 having a seat frame 12 which includes a horizontal relatively rigid seat member 14. The seat frame is carried on a pair of large wheels 16 and 18 and a pair of small wheels 20 and 22.

A patient 24, illustrated in phantom, is seated in the wheelchair on seat member 14. The patient's legs 26 and feet 28 rest on a downwardly depending leg frame 30 and footrest 32, in the usual manner. A pouch 34 preferably sewn from a multi-layer fabric panel is doubled along a fold line 36 to form an upper panel 38 and a lower panel 40. The panels are stitched along side stitch lines 44 and 46 to define a pouch having an opening 48 for receiving the patient's legs and feet within a cavity 50 as illustrated in FIG. 1. The cavity has a sufficient size to receive both the patient's legs, the leg frame, and the footrest.

For illustrative purposes, the pouch is 26" wide, has an upper panel with a length of 34½" and a lower panel with a length of 26". The upper panel is longer to cover the lap of the patient. The upper edge of the lower panel has an elastic member at 52 so the edge of the lower panel can be stretched and released. The fabric for illustrative purposes has an outer fabric material of a water repellent imitation leather which is durable in the cold. The center layer is formed of an insulation used in outer winter garments. The inner layer at 54 is of a warm, soft flannel.

Figure 3:
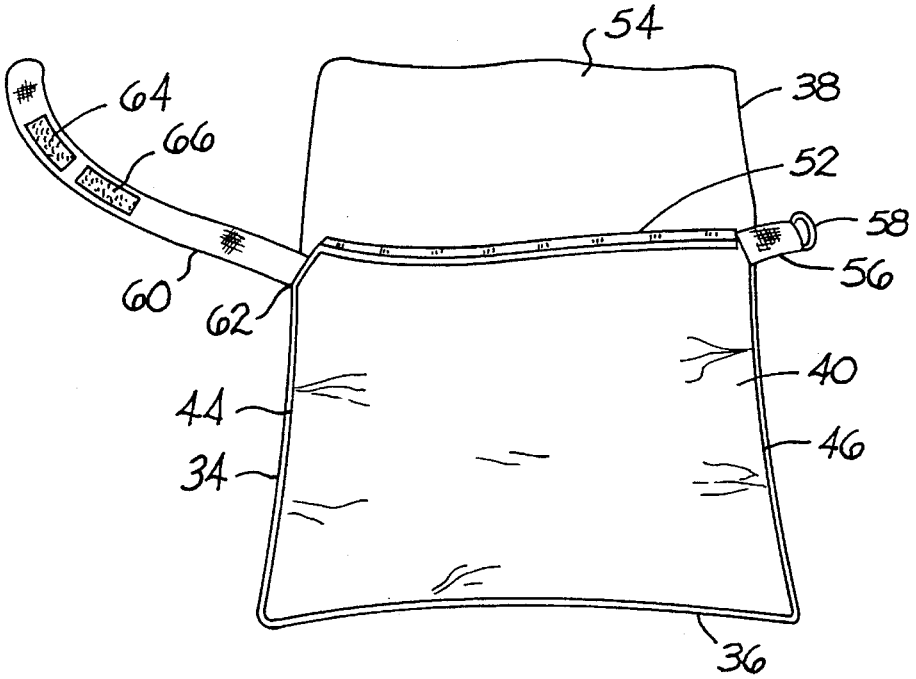
FIG. 3 is a view of the pouch separated from the wheelchair.

Referring to FIG. 3, a short strap 56 about 3½" long and 2" wide carries a brass ring 58 having a 1⅞" outer diameter.

Figure 4:
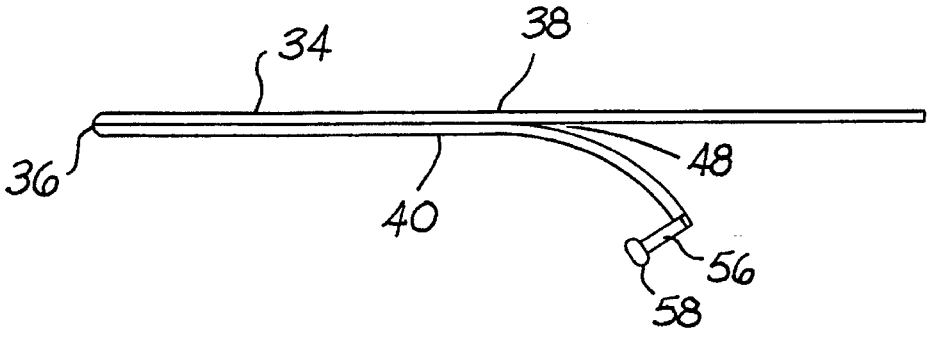
FIG. 4 is a side view of the pouch.

It is to be noted that the upper edge of the shorter lower panel, adjacent the pouch opening, is unstitched to the upper panel for a few inches, as can be seen in FIG. 4. Strap 56 is attached, as by stitching, to the edge of the lower panel as illustrated in FIG. 3.

A second longer strap 60 is attached at 62 to the opposite side edge of the lower panel adjacent the pouch opening. Strap 60 is 2" wide and about 36" long. An elongated patch 64 of a Velcro™ fabric loop material about 14½" long is attached to strap 60 about 5" from its outer end. A second elongated patch 66 of a Velcro™ fabric hook material about 11" long is attached to the same side of strap 60 adjacent patch 64.

Figure 2:
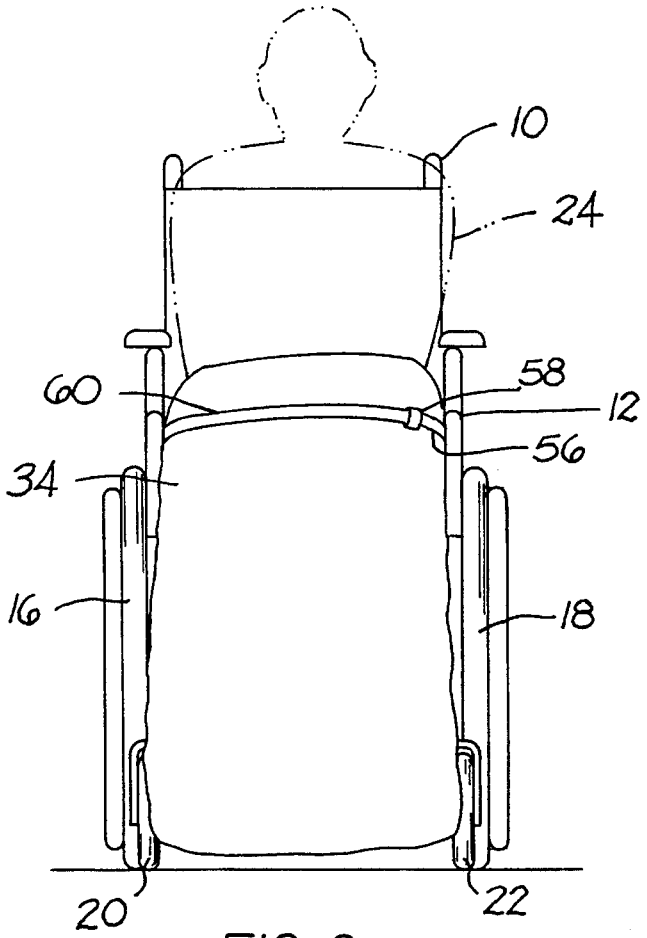
FIG. 2 is a view as seen from the right side of FIG. 1.

Referring to FIGS. 1 and 2, the pouch is used by initially seating the patient in the wheelchair with her legs resting on the footrest frame and her feet on the footrest. The pouch is then raised to receive both the patient's legs and feet and the footrest components until the lower panel is disposed beneath seat member 14 and the upper panel is disposed on the patient's lap. Strap 60 is then extended over both the patient's thighs and the upper panel, and threaded through ring 58 and then doubled back upon itself so that the patches of fabric fastener material 64 and 66 engage one another to form a snug connection around the patient's thighs and the seat member. The strap prevents the pouch from sliding down the patient's legs and forms a warm cover for the patient's legs which can be readily removed simply by separating the strap from the ring and pulling the pouch off of the patient and the wheelchair.

The pouch can be made in a variety of sizes to accommodate different size wheelchairs as well as wheelchairs having a different construction. The principle features of the invention is that the pouch can be extended up over the patient's legs and beneath the wheelchair seat so that it can be strapped around the wheelchair seat member and, depending on the wheelchair construction, through the wheelchair frame. The pouch can be made in different fabrics to accommodate either warm weather or cool weather. The pouch can be worn not only in the wheelchair but in other chairs, a vehicle seat or on patio furniture.

Having described my invention, I claim:

1. A combination comprising:

a chair structure means for supporting an occupant in a seated position, said chair structure means having a relatively rigid horizontal seat member and a downwardly depending leg frame for supporting the occupant's legs and feet when she is seated in the seat member, the leg frame being supported in a generally cantilever manner from the seat member;

a fabric pouch having an opening and a cavity for receiving the occupant's legs and the leg frame into the cavity, the pouch having a fabric lower panel extending up beneath the leg frame, the seat member and the thighs of the occupant;

a fabric upper panel extending over the lap of the occupant; and strap means attached to the lower panel and having a sufficient length to pass around both the seat member and the thighs of the occupant for connecting the pouch to the seat member.

2. A combination as defined in claim 1, in which the strap means include a pair of straps having complementary fastener means adjacent the ends thereof.

3. A combination as defined in claim 1, in which the chair structure means comprises a wheel chair.

4. A pouch for use with a chair structure means for supporting an occupant in a seated position, said chair structure means having a relatively rigid horizontal seat member and a downwardly depending leg frame for supporting the occupant's legs and feet when she is seated in the seat member, the leg frame being supported in a generally cantilever manner from the seat member, the pouch comprising;

a fabric member having an opening and a cavity for receiving the occupant's legs and the leg frame into the cavity, the fabric member having a lower panel extending up beneath the leg frame, the seat member and the thighs of the occupant;

a fabric upper panel extending over the lap of the occupant; and strap means attached to the lower panel and having a sufficient length to pass around both the seat and the thighs of the occupant for connecting the pouch to the seat member.

5. A method for enclosing the legs and feet of an occupant of a wheelchair, comprising the steps of:

seating the occupant on a horizontal seat member having a downwardly depending leg frame;

enclosing the legs of the occupant and the leg frame with a pouch by raising the pouch opening to a position in which the pouch extends beneath the seat member and above the occupants thighs; and connecting the pouch opening snugly around the seat member and the occupant's thighs.

* * * * *